United States Patent [19]

Shaffner et al.

[11] 3,995,928

[45] Dec. 7, 1976

[54] HIGH PRESSURE METAL HALIDE LAMP WITH ELECTRON COLLECTOR

[75] Inventors: Richard O. Shaffner, Willoughby; William E. Smyser, Chagrin Falls, both of Ohio

[73] Assignee: General Electric Company, Schenectady, N.Y.

[22] Filed: Jan. 13, 1975

[21] Appl. No.: 540,322

[52] U.S. Cl. ..... 315/60; 313/25; 313/184; 313/198; 313/229

[51] Int. Cl.[2] ..... H01J 61/18; H01J 61/54; H05B 31/18

[58] Field of Search ..... 313/184, 25, 198, 229; 315/60

[56] References Cited

UNITED STATES PATENTS

| | | | |
|---|---|---|---|
| 3,424,935 | 1/1969 | Gungle et al. | 313/184 |
| 3,619,711 | 11/1971 | Freese, Jr. | 313/198 X |
| 3,666,986 | 5/1972 | Lake et al. | 313/198 X |
| 3,883,763 | 5/1975 | Kearney | 313/25 X |

FOREIGN PATENTS OR APPLICATIONS

| | | |
|---|---|---|
| 1,223,955 | 3/1971 | United Kingdom |

*Primary Examiner*—Palmer C. Demeo
*Attorney, Agent, or Firm*—Ernest W. Legree; Lawrence R. Kempton; Frank L. Neuhauser

[57] ABSTRACT

A high pressure metal halide lamp comprises an outer envelope and an inner fused silica arc tube whose fill includes sodium iodide. Notwithstanding the use of a divided mount side-rod-less construction, the arc tube is subject to loss of sodium by electrolysis through the walls. The sodium loss is reduced by means of a collector wire within the outer envelope having a control potential thereon which shadows the current carrying lead wire in order to collect electrons that otherwise drift to the arc tube and promote electrolysis.

4 Claims, 6 Drawing Figures

HIGH PRESSURE METAL HALIDE LAMP WITH ELECTRON COLLECTOR

BACKGROUND OF THE INVENTION

The invention relates to high pressure metal halide arc discharge lamps and is especially applicable to such lamps containing sodium iodide.

High pressure metal halide discharge lamps generally comprise a tubular fused silica arc tube containing an ionizable fill and having a pair of main thermionic electrodes in the ends. The electrodes are supported by inleads which include a thin molybdenum ribbon portion extending hermetically through a pinch seal in the end of the lamp. Generally a starter electrode is disposed in the arc tube adjacent one of the main electrodes to facilitate starting. A discharge can be ignited across the short gap between the starter electrode and its adjacent main electrode at a much lower voltage than is required to ignite a discharge across the longer gap between the two main electrodes. Once the discharge has ignited, the ionized gas decreases the resistance between the two main electrodes and the discharge changes over into an arc between them.

The ionizable fill of metal halide lamps comprises mercury, an inert starting gas such as argon, plus one or more metal halides having useable vapor pressures and a desirable emission in the visible spectrum. One well-known metal halide charge comprises the iodides of sodium, thallium, and indium. Another well-known charge comprises the iodides of sodium, scandium, and thorium. The addition of sodium has from the beginning been troublesome because sodium ions migrate out of the arc tube during lamp operation. As sodium is selectively lost and freed iodine is left behind, the lamp spectrum deteriorates through loss of the sodium radiation and the operating voltage rises, ultimately resulting in lamp failure.

It was found that sodium loss could be greatly reduced by changing the mount frame or harness which supports the arc tube within the outer envelope from the conventional side rod construction to a divided mount construction. In the former, the so-called side rods of the frame carry current to the electrode at the opposite end of the arc tube from the lamp base. In the latter which is a reversion to an integral mount disclosed in U.S. Pat. No. 2,888,585 — Martt et al., the long side rods are eliminated and the mount is in two sections, one extending from the stem of the outer envelope to the arc tube and the other extending from the dome end of the outer envelope to the arc tube. In Electric Discharge Lamps, MIT Press 1971, John F. Waymouth explains the improvement as follows. Since the lamp operates on alternating current, the side rods alternately have a positive and a negative potential with respect to the surface of the arc tube. The side rods are bathed in ultraviolet light from the arc tube and as a result emit photoelectrons. When the side rods are negative, some of these photoelectrons drift to the outer surface of the arc tube, charging it up negatively. On the other half cycle, when the side rods are positive, there is no return photo current because silica is a very poor photo emitter. The resulting negative charge on the arc tube causes positively charged sodium ions to move through the fused silica to the outer surface where they evaporate off. When the side rods of the arc tube mount are eliminated, a major source of electrons is removed.

However even with the divided mount construction, an appreciable loss of sodium continues to take place. The object of the invention is to further reduce the loss of sodium from metal halide lamps.

SUMMARY OF THE INVENTION

Sodium loss from the fused silica envelopes of metal halide lamps can be reduced by means of a collector wire within the outer envelope having a control potential thereon. Preferably the collector wire is located close to the current carrying lead wire in order to effectively shadow it and collect electrons that otherwise would drift to the arc tube and promote sodium electrolysis.

We have found that in the divided mount construction, an important source of photoelectrons is the long lead wire that extends from the stem of the outer envelope to the electrode at the far end of the arc tube. In order to reduce the photoelectric effect, we add a collector wire to the lamp circuit and make it extend along the long lead wire and as close to it as practicable. The collector wire is connected electrically to the opposite side of the lamp circuit from the long lead wire. On the half cycle when the collector wire is positive with respect to the long lead wire, it collects a large fraction of the photoelectric current from the long lead wire. In the next half cycle the polarities are reversed and the long lead wire collects the photoelectron current from the collector wire. In this way the photoelectron current to the arc tube is greatly reduced even though the primary photoelectron current passing back and forth between long lead wire and collector wire may be approximately doubled.

In a base-down metal halide lamp the starter electrode is mounted at the dome end so as to be uppermost along with the bimetal switch, and two long lead wires extending from the stem to the dome end are provided, one running to the starter electrode and the other to the main electrode. In accordance with the invention, these wires are extended closely parallel to each other and the starter resistor is mounted at the starter end of the wire. Thus during operation the wires are at opposite polarity and a substantial reduction in sodium loss results.

In a base-up lamp, reduced sodium loss is achieved by running a collector wire, alongside the long lead wire, to a dummy terminal at the far end of the end and connecting it to the opposite a.c. potential. The effectiveness of the collector wire can be further improved by means of a rectifying diode connected in such manner as to keep the collector wire positive with respect to the arc tube throughout the a.c. cycle.

DESCRIPTION OF DRAWINGS

In the drawings wherein like symbols denote corresponding parts in the several figures.

DETAILED DESCRIPTION

Figure 1:
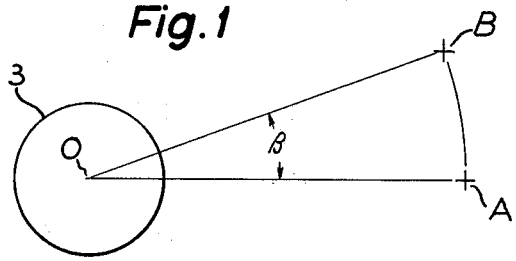
FIG. 1 represents the geometrical relationships between a tubular arc tube and a pair of conductors extending parallel thereto.

Considering a lamp comprising an inner arc tube within an outer jacket, if approximating assumptions regarding the boundary conditions determining the electric field in the outer jacket are made, it is possible to determine, by means of a current analog, the fraction $f$ of photoelectron current collected by the arc tube as a function of the arc tube surface potential normalized to the potential of the collector wire. For the geometry illustrated in FIG. 1 wherein the two wires A and B are located at 2½ arc tube diameters from the arc tube axis 0 and subtend an angle $\beta$ at the axis, the estimated average photocurrent to the arc tube per unit length of wire per emitted electron is the integral from 0 to 1 of $f$. The following values have been determined for the case where wires A and B are at differing potentials.

| Angle | Integral |
|---|---|
| 180° | .27 |
| 90° | .22 |
| 45° | .17 |
| 11° | .10 |

The foregoing indicates that if the estimated average photoelectric current is 0.5 for the case of a single wire extending along the arc tube and having an a.c. potential thereon, it will be 0.27 with two wires having opposite potentials and located 180° apart on diametrically opposite sides of the arc tube, 0.22 when the wires subtend 90° at the arc tube, and 0.10 when they subtend 11°. If the two wires located 180° apart have the same potential, the estimated average photoelectric current is 1.

Figure 2:
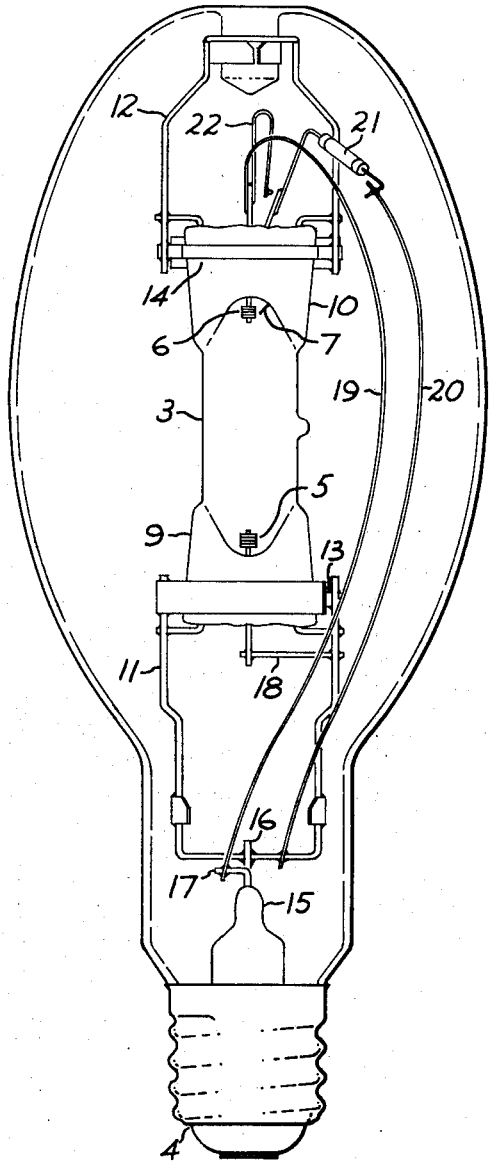
FIG. 2 is a front view of a base-down metal halide lamp embodying the invention.

FIG. 2 illustrates a metal halide divided mount lamp for base-down operation utilizing the foregoing principles to further reduce sodium loss. The lamp 1 comprises a vitreous outer envelope or bulb 2 and a fused silica inner arc tube 3, the outer envelope having a screw base 4 at its lower end. The arc tube contains a quantity of mercury which is substantially completely vaporized in operation, sodium iodide in excess of the quantity vaporized, and other suitable metal halides, for instance smaller amounts of thallium iodide and indium iodide or scandium iodide and thorium iodide. An inert rare gas at a low pressure, for instance argon at 25 torr, is included in the arc tube to facilitate starting and warm up. A pair of main arcing electrodes, 5 at the lower end and 6 at the upper end plus an auxiliary starting electrode 7 at the upper end are sealed into the arc tube. The electrodes are supported on inleads which include intermediate thin molybdenum foil sections 8 extending through the pinch-sealed ends 9, 10 of the tube. Main electrodes 5, 6 each comprise a tungsten wire helix wrapped around a core wire and may include activating material such as thorium oxide filling the interstices between turns.

The arc tube is supported within the outer envelope by a divided mount comprising a wire frame 11 at the base end and another wire frame 12 at the dome end which include metal straps 13, 14 respectively encompassing the pinch seals 9, 10. The neck of the outer envelope is closed by a re-entrant stem 15 through which extend stiff inlead wires 16, 17 connected at their outer ends to the screw shell and center contact of base 4. Lower wire frame 11 and connector 18 provide circuit continuity from inlead 16 to main electrode 5. A long, fine, and resilient curving lead wire 19 extends from inlead 17 to main electrode 6 at the upper end of the arc tube. A second curving lead wire 20 extends through frame 11 from inlead 16 to a starting resistor 21 connected to auxiliary starting electrode 7. Long curving wires 19 and 20 serve as electrical conductors only and provide substantially no physical support of the arc tube. A bimetal switch 22 is mounted on the inlead of main electrode 6 and is arranged to engage the inlead of auxiliary electrode 7 and short-circuit electrodes 6 and 7 together after the lamp has warmed up.

The starting electrode is always located at the end of the arc tube which is uppermost in order to minimize electrolysis in the fused silica about the inleads. This means that the bimetal shorting switch 22 is likewise mounted at the upper end, that is at the dome end in the base-down lamp of FIG. 2. Curving lead wire 19 carrying the arc current is made of fine tungsten wire in order to have minimum interception of ultraviolet and blue light rays which cause photoelectron emission. For the same reason, the wire is curved away from the arc tube and made to lie close to the wall of the outer envelope. Current flow through the wire, particularly at starting, causes it to heat up considerably and the choice of tungsten enables the wire to retain its resiliency and maintain its shape under these conditions. The second curving lead wire 20 matches first lead wire 19 in physical characteristics.

Figure 3:
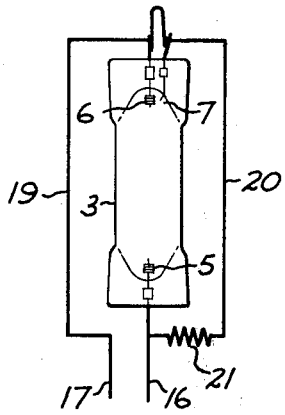
FIG. 3 shows diagrammatically the location of the starting resistor in prior art base-down lamps.

The common practice prior to our invention was to mount starting resistor 21, which limits the current to the starting electrode, at the stem or base end of the lamp. It was attached to stiff inlead 16, and the second curving lead wire 20 extended from the resistor to the inlead of starting electrode 7. The arrangement is illustrated schematically in FIG. 3 and was favored because if the two curving lead wires 19 and 20 should accidentally come into contact as a result of bumping r jarring the lamp, the starting resistor, typically of 40,000 ohms, would limit the current to a fraction of a milliampere and prevent any damage. The foregoing conventional arrangement produced the result that when the lamp attained operating temperature and bimetal switch 22 closed, both curving lead wires 19 and 20 were placed at the same potential, namely that of inlead 17. The fact that this is almost the worst possible case for photoelectron current was either not appreciated or overlooked.

Figure 4:
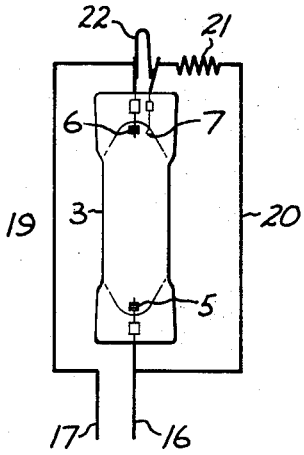
FIG. 4 shows diagrammatically the relocation of the resistor according to the invention.

In accordance with our invention, we obtain a substantial reduction in the photoelectron current by the very simple expedient of moving starting resistor 21 up to the starter electrode end of curving lead wire 20, as illustrated in FIGS. 2 and 4. In other words, starting resistor 21 is now attached to the inlead of starter electrode 7 at the upper end of the arc tube, and second curving lead wire 20 extends from inlead 16 to the starting resistor. This arrangement has the effect of leaving curving lead wires 19 and 20 at opposite polarities during operation. This change made a very substantial reduction in sodium loss and in the voltage rise associated therewith. We have found that over a 1,000 hour life test, changing the position of the starting resistor as described reduced the voltage rise from 9.1 to 3.0 volts. Since the life of a metal halide lamp containing sodium is an inverse function of voltage rise, lamp life is correspondingly improved.

Figure 5:
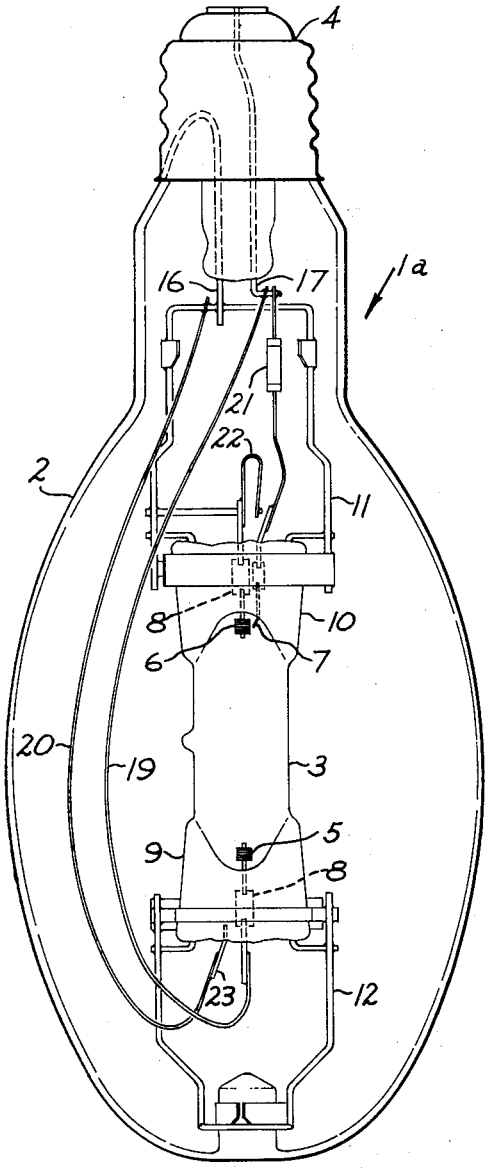
FIG. 5 is a simplified front view of a base-up lamp embodying the invention.

In the case of a lamp *1a* for base-up operation, the starting electrode 7 and the bimetal switch 22 are located at the base end of the lamp in order to be uppermost, as illustrated in FIG. 5. The practice prior to our invention was to run a single long, fine curving wire 19 from inlead 17 at the stem to the inlead of main electrode 5. Wire 19 was curved away from the arc tube and made to lie close to the outer envelope wall in order to minimize photoelectrode current to the arc tube. However, we have found that a substantial photoelectron current remains. In accordance with our invention, a further reduction is achieved by providing a second curving lead wire 20 which now extends from inlead 16 at the stem to a dummy pin 23 which is sealed into the pinched end 9 of the arc tube. The two wires 19 and 20 have opposite a.c. potentials during operation and subtend an angle of about 11° or less at the arc tube axis. This means that the photoelectron current factor is reduced from 0.5 to 0.1 or less, resulting in a substantial reduction in sodium loss and voltage rise with life.

Figure 6:
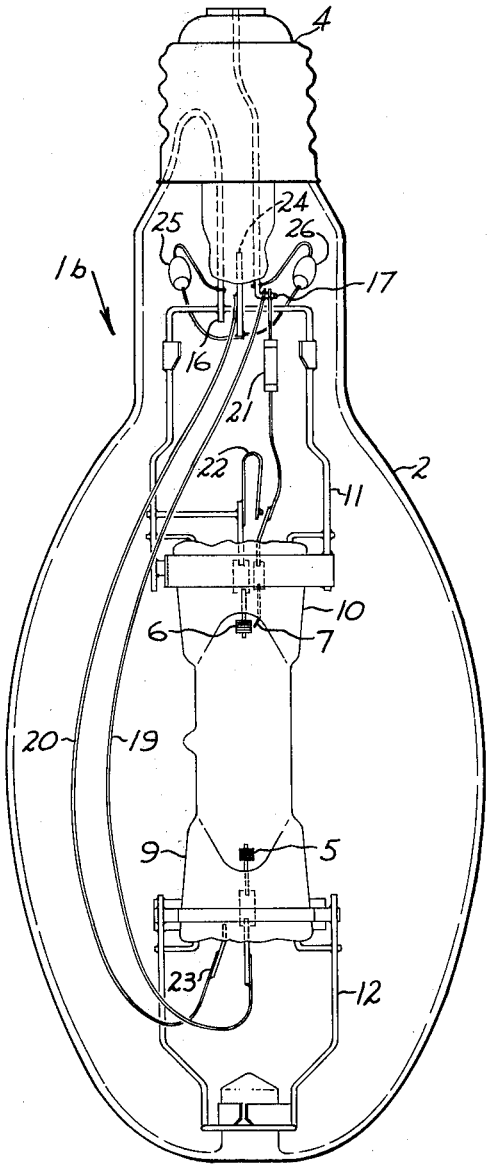
FIG. 6 is a simplified front view of another lamp embodying a variant of the invention wherein a positive bias is applied to a collector wire.

The effectiveness of curving wire 20 can be further increased by maintaining it positive with respect to the arc tube at all times throughout the a.c. cycle. A convenient arrangement for so doing is illustrated in the variant of the illustration shown in FIG. 6. In lamp *1b* otherwise similar to that of FIG. 5, the stem 15 is modified to include a dummy inlead 24. The second curving lead wire 20 extends from dummy inlead 24 of the stem to dummy pin 23 of the arc tube at the dome end of the lamp, and both wires 19 and 20 extend parallel and close together and curve away from the arc tube. A pair of solid state diodes 25, 26 are connected from inleads 16, 17, respectively, to dummy inlead 24, the polarity connections biasing inlead 24 and lead wire 20 positive. The positive potential on wire 20 is even more effective in collecting photoelectrons from wire 19 than the a.c. connection of FIG. 5 and further reduces sodium loss and voltage rise. The use of two diodes is preferred to a single diode in order to maintain a positive potential on wire 20 through both half cycles, but a single diode can suffice if adequate capacitance is provided.

What we claim as new and desire to secure by Letters Patent of the United States is:

1. A high pressure metal halide discharge lamp for base-down operation comprising:

a tubular fused silica arc tube having main arc-supporting electrodes sealed into opposite ends plus an auxiliary starting electrode in the upper end and a thermal switch mounted thereon for short-circuiting the starting electrode to the upper and main electrode at normal operating temperature, said arc tube containing an ionizable fill including mercury and sodium halide;

a generally bulbous vitreous outer envelope surrounding said arc tube, domed at the upper end and having a base with terminals at the lower end, said outer envelope having a pair of stiff inleads extending thereinto and connected to said base terminals;

a divided mount comprising a base end support frame fastened to one of said inleads and attached to the lower end of said arc tube and electrically connected to the lower end main electrode, and a dome end support frame attached to the upper end of said arc tube and engaging the dome end of said outer envelope, said divided mount providing substantially the entire physical support of said arc tube;

a fine resilient lead wire extending from said other inlead and curving along the bulbous envelope wall to the main electrode at the dome end of said arc tube;

and a collector wire extending alongside and close to said lead wire for collecting photoelectrons from said lead wire that would otherwise drift to the arc tube, said collector wire being connected to said one inlead at one end and extending to a current limiting resistor attached to said starting electrode at the other.

2. A high pressure metal halide discharge lamp for base up operation comprising:

a tubular fused silica arc tube having electrodes sealed into opposite ends and containing an ionizable fill including mercury and sodium halide, said arc tube having an auxiliary starting electrode at the upper end and a dummy pin at the lower end;

a generally bulbous vitreous outer envelope surrounding said arc tube, closed at the upper end and having a base with terminals at the lower end, said outer envelope having a pair of stiff inleads extending thereinto through a stem and connected to said base terminals;

a divided mount comprising a base end support frame fastened to one of said inleads and attached to said arc tube and electrically connected to the electrode at the upper end thereof, and a closed end support frame attached to the lower end of said arc tube and engaging the closed end of said outer envelope, said divided mount providing substantially the entire physical support of said arc tube;

a fine resilient lead wire extending from said other inlead and curving along the bulbous envelope wall to the electrode at the lower end of said arc tube;

and a collector wire extending alongside and close to said lead wire, said collector wire being connected to said one inlead at the upper end and to said dummy pin at the lower end and serving to collect photoelectrons from said lead wire that would otherwise drift to the arc tube.

3. A high pressure metal halide discharge lamp comprising:

a tubular fused silica arc tube having electrodes sealed into opposite ends and containing an ionizable fill including mercury and sodium halide;

a generally bulbous vitreous outer envelope surrounding said arc tube, domed at one end and having a base with terminals at the other, said outer envelope having a pair of stiff inleads extending thereinto through a stem and connected to said base terminals;

a divided mount comprising a base end support frame fastened to one of said inleads and attached to said arc tube and electrically connected to the electrode at one end thereof, and a dome end support frame attached to the other end of said arc tube and engaging the dome end of said outer envelope, said divided mount providing substantially the entire physical support of said arc tube;

a fine resilient lead wire extending from said other inlead and curving along the bulbous envelope wall to the electrode at the dome end of said arc tube;

a collector wire extending alongside and close to said lead wire;

and at least one diode rectifier connected between one of said inleads and said collector wire and poled to bias said collector wire positive in order to collect photoelectrons from said lead wire that would otherwise drift to the arc tube.

4. A lamp as in claim 3 wherein said stem includes a dummy inlead, said collector wire is attached to said dummy inlead, and a pair of diodes are connected between said inleads and said dummy inlead and are poled to bias said collector wire positive.

* * * * *